US009976404B2

(12) United States Patent
Mueller et al.

(10) Patent No.: US 9,976,404 B2
(45) Date of Patent: May 22, 2018

(54) DOWNHOLE TOOL INCLUDING A MULTI-CHIP MODULE HOUSING

(71) Applicants: Stephan Mueller, Lower Saxony (DE); Hans Robert Oppelaar, Lower Saxony (DE); Robert Buda, Celle (DE); Henning Rahn, Niedersachsen (DE); Carsten Haubold, Celle (DE); Ingo Roders, Seelze (DE); Detlev Benedict, Celle (DE)

(72) Inventors: Stephan Mueller, Lower Saxony (DE); Hans Robert Oppelaar, Lower Saxony (DE); Robert Buda, Celle (DE); Henning Rahn, Niedersachsen (DE); Carsten Haubold, Celle (DE); Ingo Roders, Seelze (DE); Detlev Benedict, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 477 days.

(21) Appl. No.: 14/282,792

(22) Filed: May 20, 2014

(65) Prior Publication Data

US 2015/0337641 A1 Nov. 26, 2015

(51) Int. Cl.
*E21B 47/01* (2012.01)
*E21B 44/00* (2006.01)

(52) U.S. Cl.
CPC ..... *E21B 44/005* (2013.01); *E21B 47/011* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,547,833 | A | 10/1985 | Sharp | |
| 4,694,555 | A * | 9/1987 | Russell | H05K 7/1417 174/544 |
| 4,943,489 | A | 7/1990 | Kuhara et al. | |
| 5,144,126 | A | 9/1992 | Perry et al. | |
| 5,344,337 | A | 9/1994 | Ritter | |
| 5,720,342 | A | 2/1998 | Owens et al. | |

(Continued)

FOREIGN PATENT DOCUMENTS

| | | | |
|---|---|---|---|
| CN | 1415044 | A | 4/2003 |
| WO | 2012135406 | A2 | 10/2012 |
| WO | 2013101688 | A2 | 7/2013 |

OTHER PUBLICATIONS

Bansal et al., "Harsh-Environment Packaging for Downhole Gas and Oil Exploration", ProQuest Dialog, Aug. 7, 2008, pp. 1-2, retrieved from http://search.proquest.com/professional/docview/1345587043?accountid=157282.

(Continued)

*Primary Examiner* — David J Bagnell
*Assistant Examiner* — Ronald R Runyan
(74) *Attorney, Agent, or Firm* — Cantor Colburn LLP

(57) ABSTRACT

A downhole tool includes a tool body having an inner surface portion and an outer surface portion. The outer surface portion includes a recess having a peripheral wall and an inner surface. A multi-chip module (MCM) housing is defined in the recess. The MCM housing includes one or more fortifying members that support axial and radial loading of the downhole tool and include one or more electronics receiving zones.

18 Claims, 10 Drawing Sheets

(56) References Cited

U.S. PATENT DOCUMENTS

| | | | | |
|---|---|---|---|---|
| 5,931,000 | A * | 8/1999 | Turner | E21B 36/003 166/66 |
| 6,351,891 | B1 * | 3/2002 | MacGugan | E21B 47/024 33/304 |
| 6,499,541 | B1 * | 12/2002 | Hiron | E21B 47/011 166/162 |
| 6,531,767 | B2 | 3/2003 | Shrauger | |
| 6,666,285 | B2 | 12/2003 | Jones et al. | |
| 6,880,647 | B2 | 4/2005 | Villareal | |
| 6,942,043 | B2 * | 9/2005 | Kurkoski | E21B 47/01 175/40 |
| 7,178,607 | B2 | 2/2007 | Mayes | |
| 7,268,019 | B2 | 9/2007 | Golla et al. | |
| 7,363,971 | B2 | 4/2008 | Rodney et al. | |
| 8,585,423 | B2 | 11/2013 | Marklove et al. | |
| 8,637,980 | B1 | 1/2014 | Lower et al. | |
| 2005/0218898 | A1 * | 10/2005 | Fredette | G01V 3/30 324/342 |
| 2007/0007008 | A1 | 1/2007 | Sherrill | |
| 2007/0117268 | A1 | 5/2007 | Bell | |
| 2008/0041583 | A1 | 2/2008 | Angman et al. | |
| 2009/0303686 | A1 | 12/2009 | Hall et al. | |
| 2011/0024188 | A1 | 2/2011 | Wassell et al. | |
| 2012/0096935 | A1 | 4/2012 | Finke et al. | |
| 2012/0324993 | A1 | 12/2012 | Nakajima et al. | |
| 2013/0087903 | A1 | 4/2013 | Cherchali et al. | |
| 2013/0271066 | A1 | 10/2013 | Signorelli et al. | |
| 2014/0076633 | A1 | 3/2014 | Terracina et al. | |

OTHER PUBLICATIONS

International Search Report and Written Opinion of the International Search Authority dated Aug. 28, 2015 in related PCT Application No. PCT/US2015/031100, 10 pages.

International Search Report and Written Opinion of the International Search Authority dated Aug. 24, 2015 in related PCT Application No. PCT/US2015/031516, 10 pages.

* cited by examiner

DOWNHOLE TOOL INCLUDING A MULTI-CHIP MODULE HOUSING

BACKGROUND

In sub-terrain drilling, downhole tools are often provided with various sensors to detect various downhole parameters. Sensors may be used for measuring, logging, telemetry, steering, and the like. The sensor measurement data may be processed by electronic components to evaluate the data, transmit the data, or use the measurement values for direct control. The electronic components must be able to withstand high temperatures, accelerations and other downhole environment conditions. The electronic components are typically built in the form of multi-chip module (MCM) electronics that are provided in recesses that are disposed in the downhole tool. MCM electronics are composed of dies (integrated circuits). These dies are sensitive to various gases e.g. fluorine and chlorine and therefor require a separate housing. The MCM housing is designed to protect the MCM electronics from harmful gases. A sleeve, or coverplate, generally covers the MCM housing. The sleeve, or coverplate, encapsulates the MCM housing to provide protection from hydrostatic drilling load forces and drilling mud.

SUMMARY

A downhole tool in accordance with an exemplary embodiment includes a tool body having an inner surface portion and an outer surface portion. The outer surface portion includes a recess having a peripheral wall and an inner surface. A multi-chip module (MCM) housing is defined in the recess. MCM housing includes one or more fortifying members that support axial and radial loading of the downhole tool and one or more electronics receiving zones.

BRIEF DESCRIPTION OF THE DRAWINGS

Referring now to the drawings wherein like elements are numbered alike in the several Figures.

DETAILED DESCRIPTION

Figure 1:
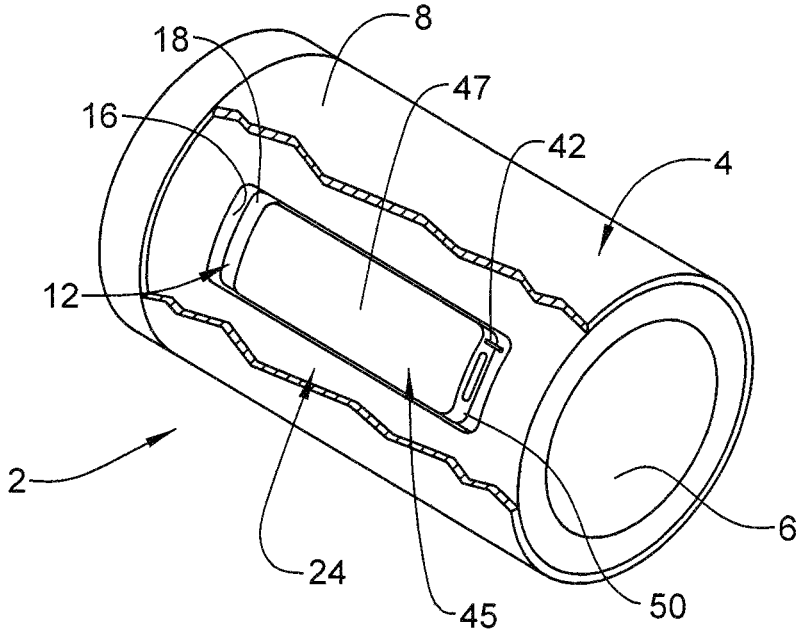
FIG. 1 depicts a perspective view of a portion of a downhole tool including a multi-chip module (MCM) housing, in accordance with an exemplary embodiment.
Figure 3:
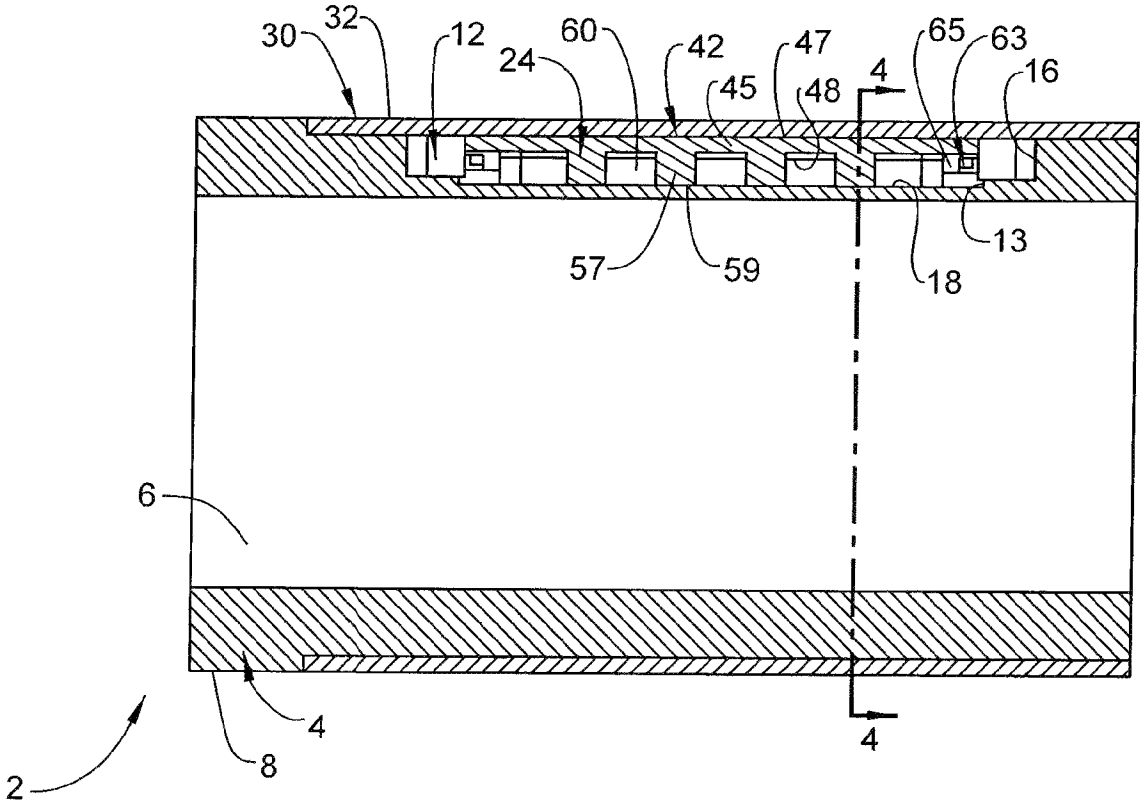
FIG. 3 depicts a cross-sectional side view of the downhole tool of FIG. 1.

A downhole tool, in accordance with an exemplary embodiment, is indicated generally at 2, in FIG. 1. Downhole tool 2 includes a tool body 4 having an inner surface portion 6 and an outer surface portion 8. Tool body 4 includes a recess 12 having an edge 13 (FIG. 3). Recess 12 is also surrounded by a peripheral wall 16 and includes an inner surface 18. In accordance with an aspect of an exemplary embodiment, tool body 4 includes a multi-chip module (MCM) housing 24 arranged within recess 12. As will be detailed more fully below, MCM housing 24 is designed to protect electronic components (not shown) from harmful gases, abrasion, and flow and carry loads from the tool body 4. In addition, an outer cover 30 is provided over tool body 4 and recess 12. Outer cover 30 is shown in the form of a sleeve 32 that extends entirely about tool body 4 and provides additional support for withstanding hydrostatic loads. Of course, it should be understood that outer cover 30 could also take the form of a hatch or cover that extends only partially about tool body 4.

Figure 2:
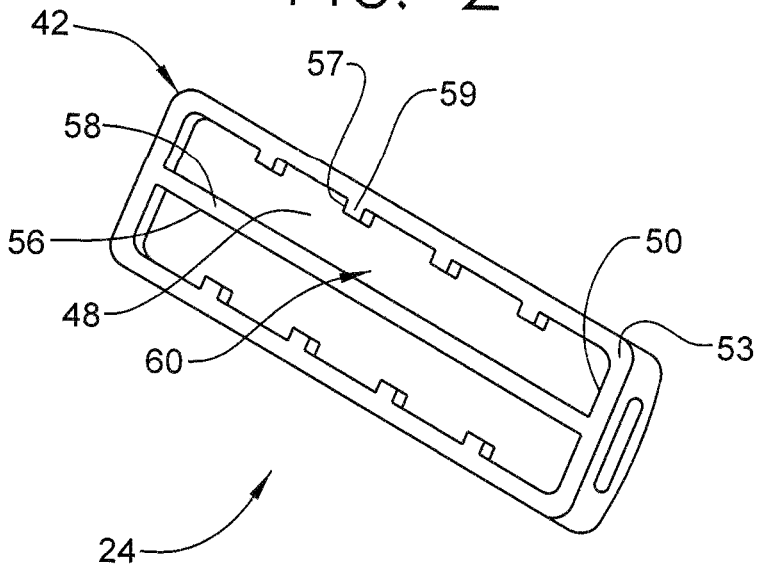
FIG. 2 depicts the MCM housing of FIG. 1.
Figure 4:
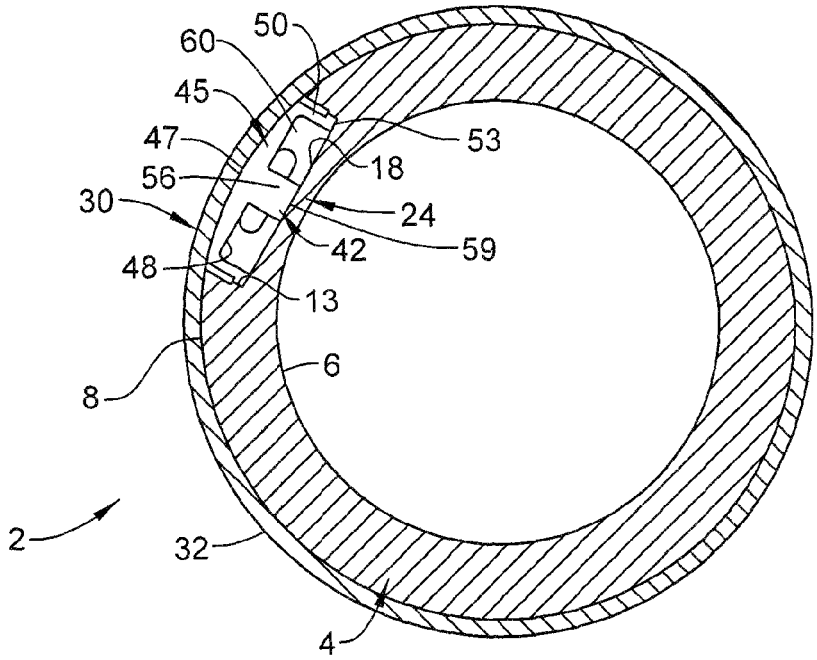
FIG. 4 depicts a cross-sectional axial end view of the downhole tool of FIG. 1.

As shown in FIGS. 2-4, MCM housing 24 includes a housing body 42 having a portion 45 including a first surface 47 and a second, opposing surface 48. Portion 45 may include a shape that generally corresponds to outer surface portion 8. A peripheral wall 50 extends about portion 45. Peripheral wall 50 includes an outer peripheral edge 53 that engages inner surface 18 and edge 13. MCM housing 24 may also include a plurality of fortifying members, two of which are indicated at 56 and 57, that project from second surface 48. Fortifying members 57 may also project from peripheral wall 50. Fortifying members 56 and 57 may be integrally formed with MCM housing 24 or may constituted separate components. Each fortifying member 56, 57 includes a corresponding cantilevered end portion 58 and 59 that define, together with second surface 48 and peripheral wall 50, one or more electronics receiving zones 60. Electronics receiving zones 60 house sensors and/or other electronic components in tool body 4.

In accordance with an exemplary aspect, MCM housing 24 is supported in recess 12 upon inner surface 18 and thus may form part of a redundant assembly (not separately labeled) that may provide additional protection over and above that which may be provided by outer cover 30 to internally arranged components. Specifically, outer peripheral edge 53 and cantilevered end portions 58, 59 abut inner surface 18 and support portion 45. In this manner, MCM housing 24 is capable of withstanding hydrostatic loading and protects internal electronic components, by substantially maintaining a volume of electronics receiving zones 60. Further, MCM housing 24 provides protection for the electronic components without increasing an overall radial thickness of downhole tool 2. Once in place, outer peripheral edge 53 may be bonded to tool body 4. For example, outer peripheral edge 53 may be welded or otherwise fused to edge 13 as shown in FIGS. 3 and 4. Of course, it should be understood that other forms of bonding may also be employed. One or more connectors, such as shown at 63, may be mounted to MCM housing 24. Connector 63 is shown in the form of a pressure feed-through 65, however, it should be understood that other forms of connectors, both wired and wireless, may be employed. Once in place, outer sleeve 30 is positioned across MCM housing 24. No longer required to accommodate all hydrostatic loading, outer sleeve 30 may now having a thinner cross section. The pressure feed typically includes a ceramic or glass seal, surrounding an inner conductor (not separately labeled) of connector 63. Connector 63 may also have more than one conductor and terminal end.

Figure 5:
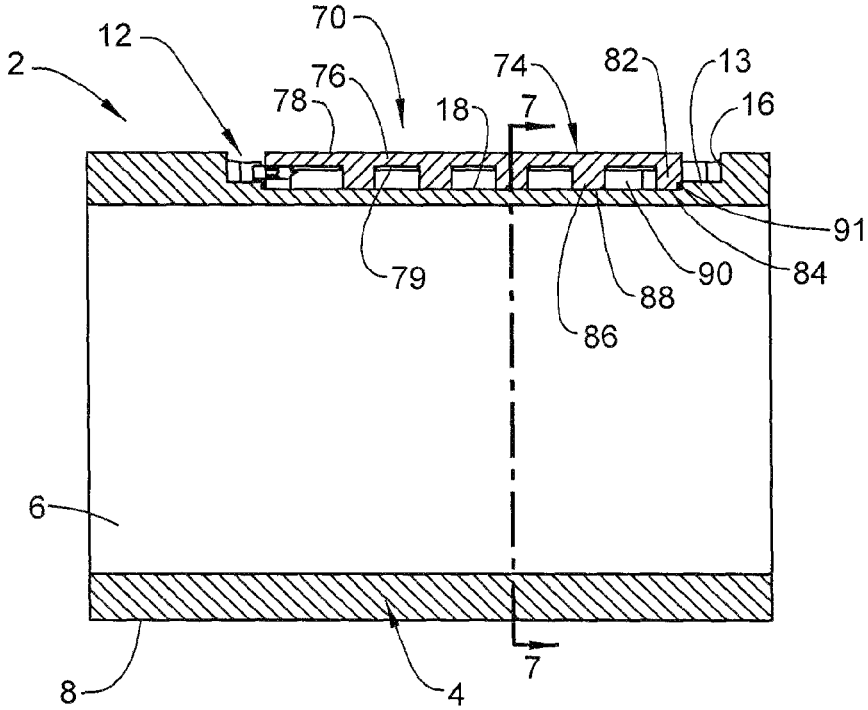
FIG. 5 depicts a cross-sectional side view of a downhole tool including an MCM housing, in accordance with another aspect of an exemplary embodiment.
Figure 6:
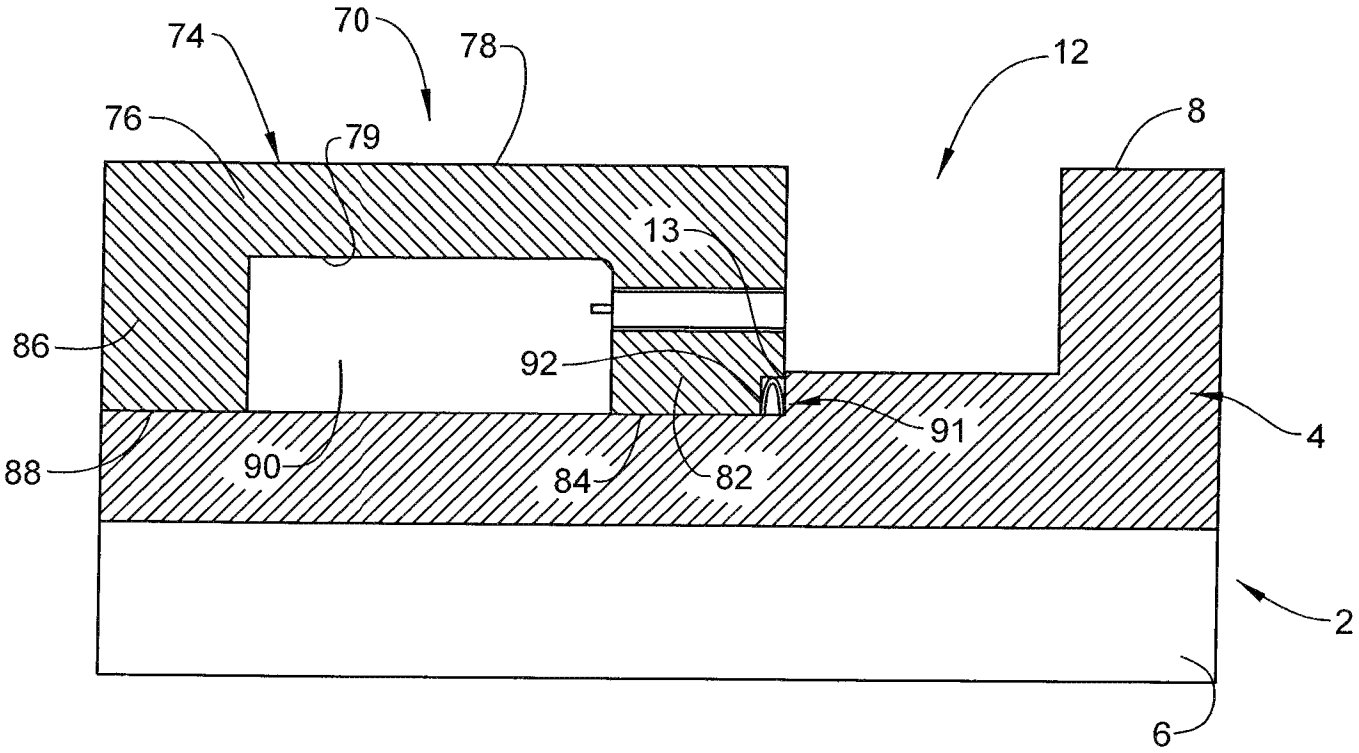
FIG. 6 depicts a detailed view of the MCM housing of FIG. 5 illustrating a seal providing a connection to the downhole tool.
Figure 7:
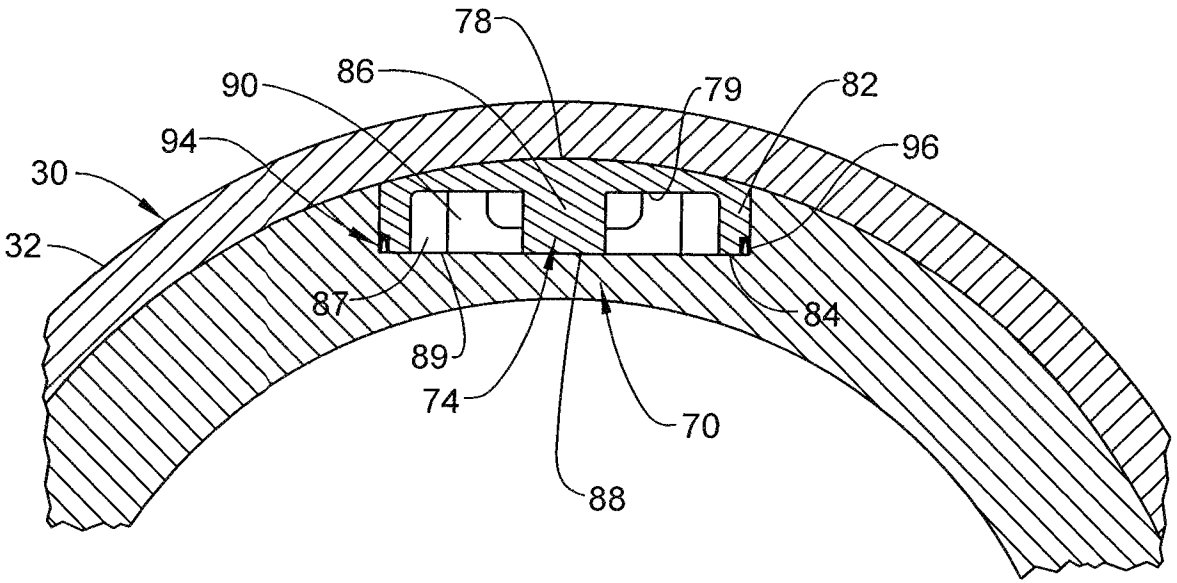
FIG. 7 depicts a cross-sectional axial end view of the downhole tool of FIG. 5.

Reference will now follow to FIGS. 5-7, wherein like reference numbers represent corresponding parts in the respective views, in describing a MCM housing 70 in accordance with another aspect of an exemplary embodiment. MCM housing 70 includes a housing body 74 having a portion 76 including a first surface 78 and a second, opposing surface 79. Portion 76 may include a shape that generally corresponds to outer surface portion 8. A peripheral wall 82 extends about portion 76. Peripheral wall 82 includes an outer peripheral edge 84 that engages inner surface 18 and edge 13. MCM housing 70 may also include a plurality of fortifying members, two of which are indicated at 86 and 87, that project from second surface 79. Fortifying members 87 may also project from peripheral wall 82. As indicated above, fortifying members 86 and 87 may be integrally formed with MCM housing 70 or could constitute separate components. Each fortifying member 86, 87 includes a corresponding cantilevered end portion 88, 89 that define, together with second surface 79 and peripheral wall 82, one or more electronics receiving zones 90. Electronics receiving zones 90 house sensors and/or other electronic components in tool body 4.

In accordance with the exemplary embodiment shown, MCM housing 70 is detachably mounted within recess 12 through a first seal 91 and may form part of a redundant assembly (not separately labeled) that provides additional protection over and above that which may be provided by outer cover 30 to internally arranged components. First seal 91 takes the form of a spring loaded radial seal 92 having a generally C-shaped cross-section. Of course, it should be understood that first seal 91 may take on a variety of geometries and may or may not be spring loaded. MCM housing 70 also includes a second seal 94. Second seal 94 takes the form of a spring loaded axial seal 96 similar to that described in connection with spring loaded radial seal 92. First and second seals 91 and 94 may be metallic seals formed from stainless steel, a metal alloy, silver, copper and gold, or may possess a metallic coating, such as stainless steel, a metal alloy, silver, copper and gold. The particular type of metallic coating may vary. The metallic coating is generally chosen to be non-reactive with downhole formation materials and/or mud. It should also be understood that MCM housing 70 may include a single continuous seal that extends both axially and radially. It should be further understood that MCM housing 70 may include an integral seal. Conversely, a seal may be built into tool body 4. Once installed, MCM housing 70 may be covered by outer sleeve 30. No longer required to accommodate all hydrostatic loading, outer sleeve 30 may now having a thinner cross section.

Figure 8:
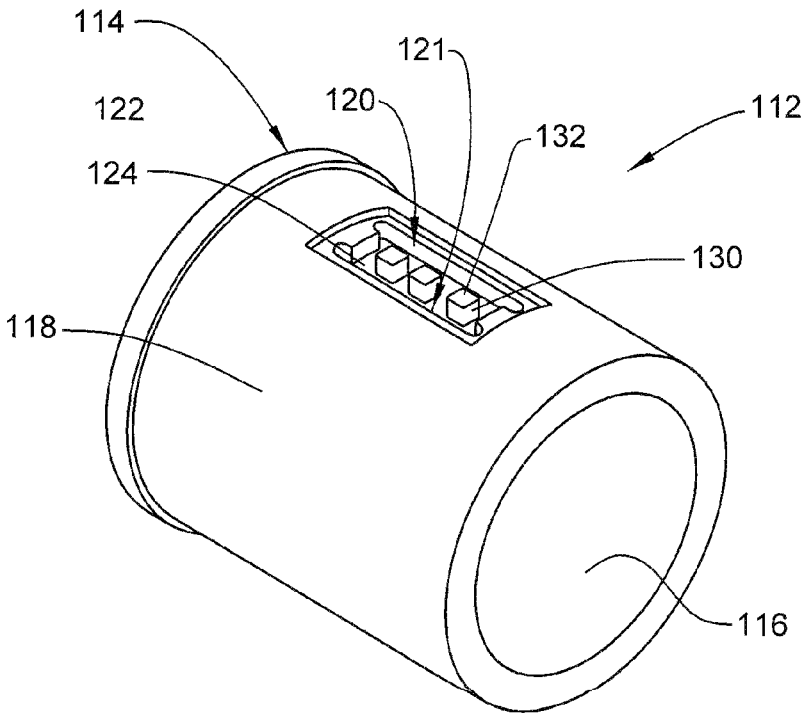
FIG. 8 depicts a perspective view of a portion of a downhole tool including a multi-chip module (MCM) housing, in accordance with another aspect of an exemplary embodiment.
Figure 9:
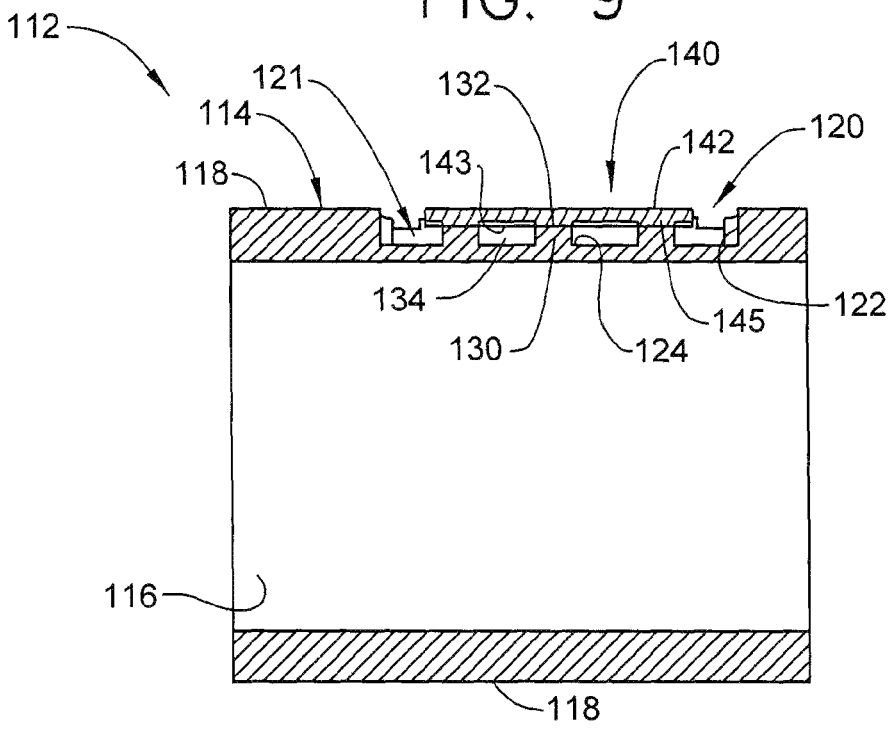
FIG. 9 is a cross-sectional side view of the downhole tool of FIG. 8.

Reference will now be made to FIGS. 8-9 in describing a downhole tool 112, in accordance with another aspect of an exemplary embodiment. Downhole tool 112 includes a tool body 114 having an inner surface portion 116 and an outer surface portion 118. Tool body 114 includes a recess 120 that defines a MCM housing 121. MCM housing 121 includes a peripheral wall 122 and an inner surface 124. In the exemplary aspect shown, MCM housing 121 includes a plurality of fortifying members 130 that extend outwardly of inner surface 124. Fortifying members 130 may be integrally formed with inner surface 124 or may be separate components. Each of the plurality of fortifying members 130 includes a cantilevered end portion 132 that is below outer surface portion 118. In a manner similar to that described above, fortifying members 130, together with inner surface 124 and peripheral wall 122, define a plurality of electronics receiving zones 134.

In further accordance with the exemplary embodiment shown, downhole tool 2 includes a strengthening element 140 that extends across MCM housing 121. Strengthening element 140 includes a first surface portion 142 and an opposing, second surface portion 143. Second surface portion 143 includes a plurality of strengthening members, one of which is shown at 145, that correspond to each of the plurality of fortifying members 130. Strengthening element 140 provides a cover for MCM housing 121 as well as provides structure that may accommodate hydrostatic loading. Once in place, strengthening element 140 may be covered by a sleeve (not shown). No longer required to accommodate all hydrostatic loading, the sleeve may now have a thinner cross section. Strengthening element 140 may be bonded, such as through welding, or sealed with a metallic seal to fortifying members 130 to protect electronic components (not shown) in electronics receiving zones 134 from exposure to outgassing.

Figure 10:
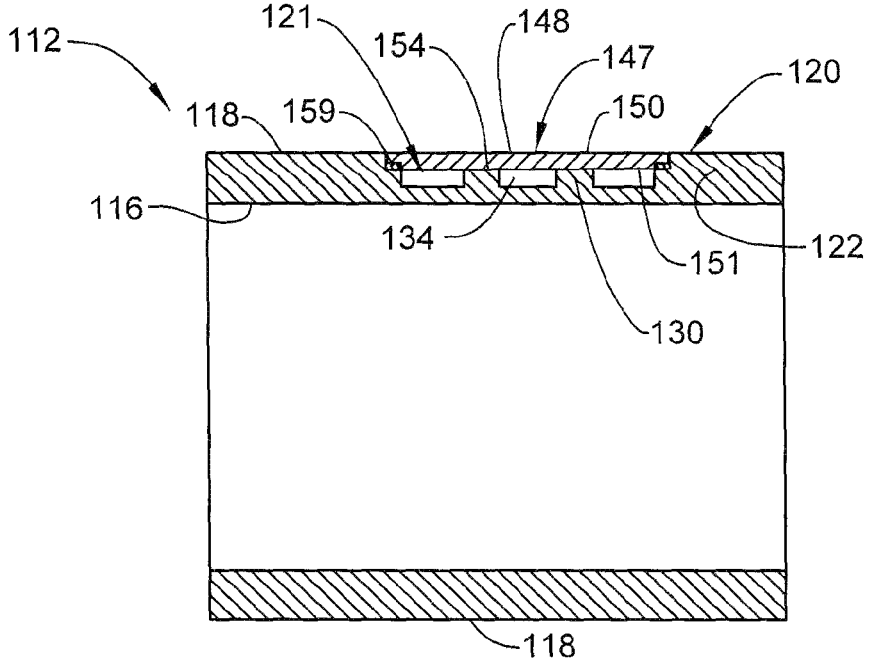
FIG. 10 is a cross-sectional side view of the downhole tool of FIG. 8, in accordance with another aspect of an exemplary embodiment.

FIG. 10, in which like numbers represent corresponding parts in the respective views, shows the use of a cover 147, depicted as a hatch cover 148 having a first surface section 150 and an opposing, second surface section 151. Hatch cover 148 extends only partially about tool body 114 and nests within a recess (not separately labeled) that is provided at MCM housing 121. Second surface section 151 includes a strengthening member 154. With this arrangement, sleeve 148 serves as both an outer seal and fortifying structure that enables MCM housing 121 to withstand hydrostatic loading without the need for the additional strengthening element. In addition, a seal, such as indicated at 159, may be provided about sleeve 148 while preventing outgassing into MCM housing 121.

Figure 11:
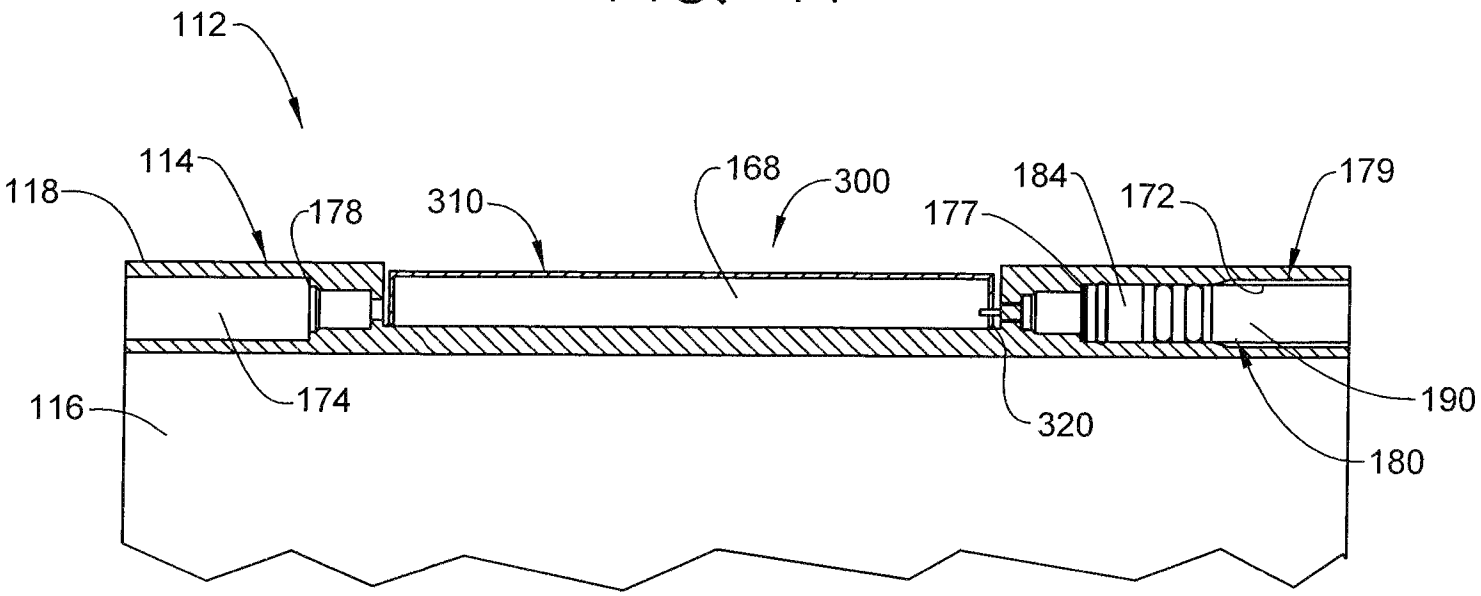
FIG. 11 depicts a cross-sectional side view of a downhole tool having a removable electronic component access member in accordance with an exemplary embodiment.
Figure 12:
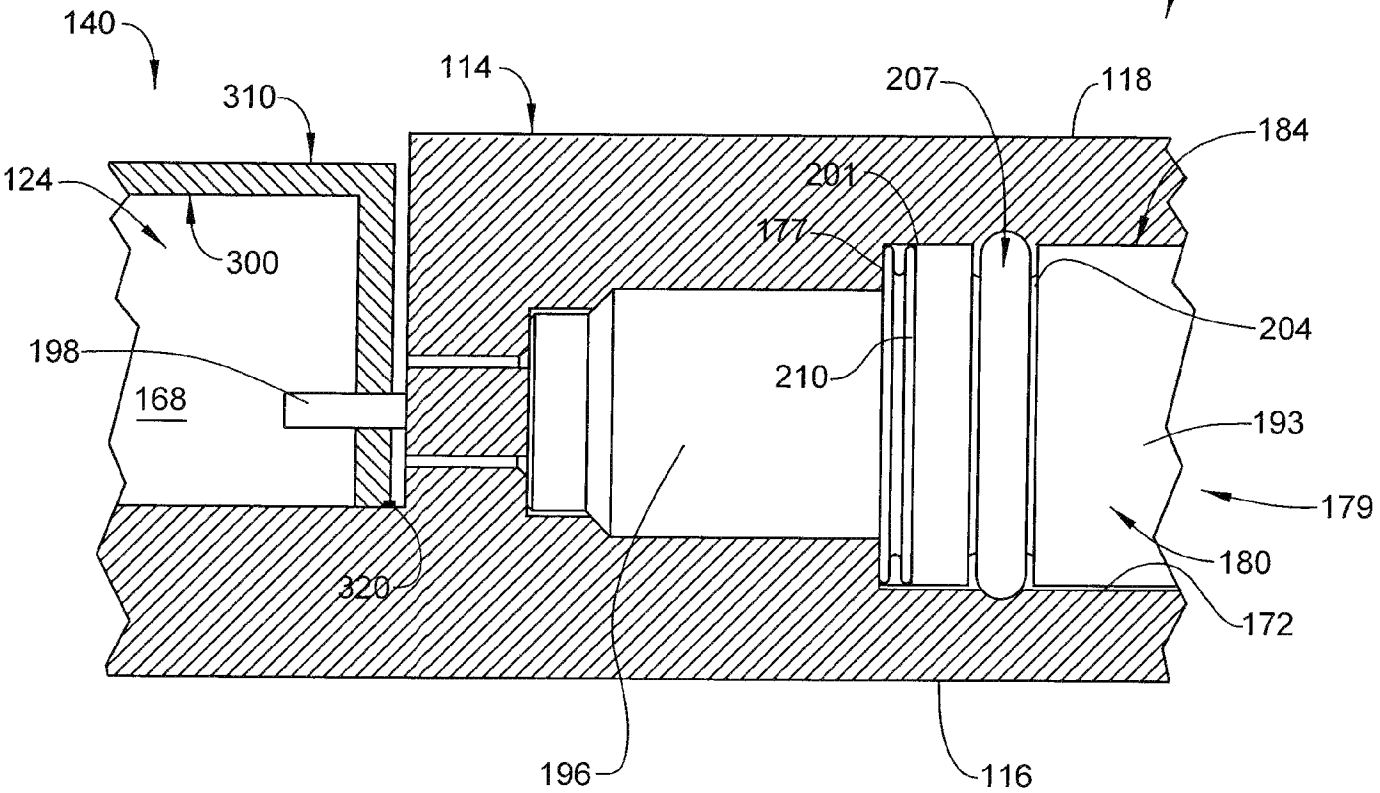
FIG. 12 depicts a detailed view of the removable electronic component access member in accordance with aspects of an exemplary embodiment.

FIGS. 11 and 12 illustrate a downhole tool 160 having a tool body 162. Tool body 162 includes a recess 168 that houses electronic components (not shown) Tool body 162 is also shown to include a first connector receiving zone 172 extending axially outwardly of recess 168 in a first direction and a second connector receiving zone 174 extending axially outwardly of recess 168 in a second, opposing direction. Connector receiving zone 172 may also extend radially outwardly of, or at any angle relative to, recess 168. First connector receiving zone 172 includes a first seal land 177 and second connector receiving zone 174 includes a second seal land 178. In the exemplary embodiment shown, a removable electronic component access member 179 is mounted to tool body 162. The term "removable" should be understood to describe that electronic component access member 179 may be separated from tool body 162 without the need for cutting, or other process that would lead to the destruction of downhole tool 160 or access member 179.

In accordance with an aspect of the exemplary embodiment, removable electronic component access member 179 may take the form of a detachable connector 180. Detachable connector 180 may take the form of a pressure feed through 184, arranged in first connector receiving zone 172.

By "detachable", it should be understood that connector 180 may be removed from connector receiving zone 172 without the need for severing welds, or other bonds, and that detachable connector 180 may be reused following removal. For example, detachable connector 180 may be threadably engaged with connector receiving zone 170, or may employ a shaped memory alloy material that may engage connector receiving zone 170 when exposed to elevated temperatures such as found in a downhole environment, clamping and the like. Detachable connector 180 may also be readily installed into first connector receiving zone 172 without the need for welds or other permanent means of attachment. For example, detachable connector 180 may be threadably engaged with connector receiving zone 170.

Pressure feed through 184 is connected to a conduit 190 that leads to an adjacent downhole component (not shown). As best shown in FIG. 12, pressure feed through 184 also includes a body 193 having a terminal end 196 provided with a pin 198. Terminal end 196 is engaged within first connector receiving zone 172 with pin 198 extending toward recess 168. In this manner, pin 198 may provide a connection to an electronic component arranged within one of electronics receiving zones 134.

In accordance with an exemplary embodiment, body 193 includes a step section 201 and a groove 204. Groove 204 extends circumferentially about body 193 and receives an electrical contact 207. Electrical contact 207 is radially outwardly biased to provide a connection between pressure feed through 184 and tool body 4 that may establish an electrical ground or a conductive pathway for other signals. In accordance with an exemplary aspect, electrical contact 207 defines a spring contact. Pressure feed through 184 also includes a seal 210 arranged at step section 201 of body 193. Seal 210 is positioned between step section 201 and first seal land 177 to prevent gasses from entering recess 168 while allowing connector 180 to be removed from tool body 4. In accordance with an aspect of the exemplary embodiment, seal may be formed from metal such as stainless steel, a metal alloy, silver, copper and gold, or may possess a metallic coating, such as stainless steel, a metal alloy, silver, copper and gold. The metallic coating is generally chosen to be substantially non-reactive with downhole formation materials.

In accordance with an aspect of an exemplary embodiment, detachable connector 180 not only facilitates easy and repeated installation and removal but also provides access to electronic components (not shown) housed in recess 168 in tool body 114. In further accordance with an aspect of an exemplary embodiment, tool body 114 may include a removable electronic component access member 300 in the form of a removable multi-chip module (MCM) housing 310 provided in recess 168. MCM housing 310 may be secured to tool body 114 in recess 168 through a metallic seal 320.

At this point it should be understood, that the exemplary embodiments describe a MCM housing that is capable of carrying a high percentage of hydrostatic pressure applied to a downhole tool as well as other applied loads such as those provided by threaded connections, drillstring torsion, bit weight, bit torque and the like. The MCM housing also protects electronic components from exposure to outgassing and other downhole conditions. Further, the MCM housing is formed from a material that is resistant to exposure to potentially corrosive downhole formations. It should also be understood, that the particular shape and internal geometry of the MCM housing may vary and could be adapted to a wide variety of applications.

Figure 13:
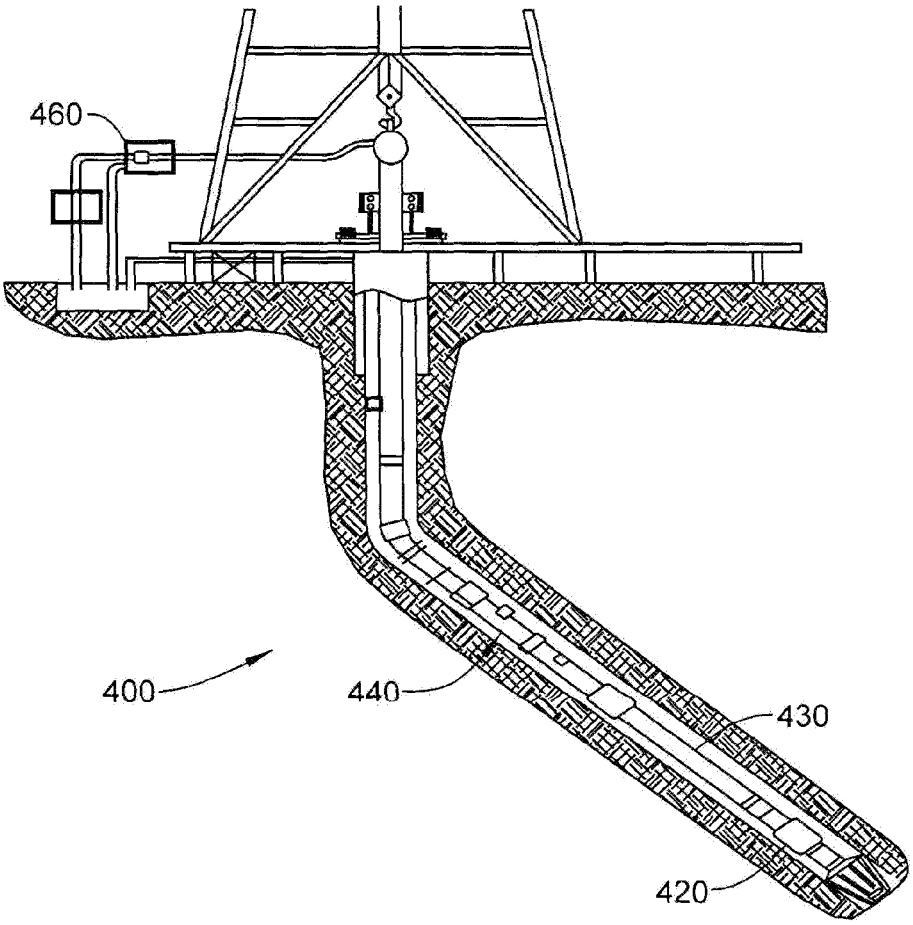
FIG. 13 depicts a downhole system employing a downhole tool having a removable electronic component access member in accordance with an exemplary embodiment.

It should be further understood, that the downhole tool in accordance with exemplary embodiments may form part of an overall downhole system 400, illustrated in FIG. 13. For example, the exemplary embodiments may be operatively associated with, or facilitate communication between, a steering device 420, a mud motor 430 or other downhole electronic devices such as logging while drilling elements 440. The exemplary embodiments may also facilitate communication between downhole components and uphole components such as controllers 460.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole tool comprising:

a tool body having an inner surface portion and an outer surface portion, the outer surface portion including a recess having a peripheral wall and an inner surface;

an outer cover extending about the recess, the outer cover being configured and disposed to support a first portion of radial loading of the downhole tool; and a multi-chip module (MCM) housing defined in the recess and covered by the outer cover, the MCM housing including a housing body defining an electronics receiving zone and one or more fortifying members that support a second portion of the radial loading of the downhole tool, the one or more fortifying members and the inner surface of the recess defining the electronics receiving zone and substantially maintaining a volume of the electronics receiving zone in response to the second portion of the radial loading.

2. The downhole tool according to claim 1, wherein the MCM housing includes a first portion having a first surface and an second surface, and an outer peripheral edge that extends about the second surface, the outer peripheral edge abutting the inner surface of the recess and defining, at least in part, the one or more electronics receiving zones.

3. The downhole tool according to claim 2, wherein the one or more fortifying members extend from the second surface.

4. The downhole tool according to claim 3, wherein each of the one or more fortifying members includes a cantilevered end portion abutting the inner surface of the recess.

5. The downhole tool according to claim 1, further comprising: at least one connector mounted to the MCM housing.

6. The downhole tool according to claim 1, wherein the MCM housing is welded to the tool body.

7. The downhole tool according to claim 1, wherein the MCM housing is removably mounted in the recess.

8. The downhole tool according to claim 7, further comprising: a seal securing the MCM housing in the recess.

9. The downhole tool according to claim 8, wherein the seal is arranged between the peripheral wall and the MCM housing.

10. The downhole tool according to claim 8, wherein the seal includes a C-shaped cross-section.

11. The downhole tool according to claim 8, wherein the seal comprises a spring loaded seal.

12. The downhole tool according to claim 8, wherein the seal comprises a metallic seal.

13. The downhole tool according to claim 12, wherein the metallic seal comprises one of stainless steel, a metal alloy, silver, copper and gold.

14. The downhole tool according to claim 8, wherein the seal is distinct from the MCM housing.

15. The downhole tool according to claim 1, wherein the outer cover comprises a sleeve disposed over the outer surface portion of the downhole tool covering the recess and the MCM housing.

16. The downhole tool according to claim 1, wherein the downhole tool forms part of a downhole system.

17. The downhole tool according to claim 16, wherein the tool body is operatively associated with one of a steering device, a mud motor and a logging while drilling element.

18. The downhole tool according to claim 1, wherein the MCM housing forms part of a redundant assembly.

* * * * *